US005089679A

United States Patent [19]

Eke

[11] Patent Number: 5,089,679

[45] Date of Patent: Feb. 18, 1992

[54] MICROWAVE OVEN WITH STAND-BY MODE

[75] Inventor: Kenneth I. Eke, Woldingham, England

[73] Assignee: Microwave Ovens Limited, Surrey, England

[21] Appl. No.: 397,003

[22] Filed: Aug. 22, 1989

[30] Foreign Application Priority Data

Sep. 9, 1988 [GB] United Kingdom ..... 8821213
Jul. 13, 1989 [GB] United Kingdom ..... 8916074

[51] Int. Cl.[5] ..... H05B 6/68

[52] U.S. Cl. ..... 219/10.55 B; 219/10.55 E; 219/400; 126/21 A

[58] Field of Search ..... 219/10.55 R, 10.55 B, 219/10.55 E, 400, 489; 126/21 R, 21 A; 99/325, DIG. 14

[56] References Cited

U.S. PATENT DOCUMENTS 3,253,532 5/1966 Jones ..... 219/400
3,514,576 5/1970 Hilton et al. ..... 219/400
3,569,656 3/1971 White et al. ..... 219/10.55 B
3,604,896 9/1971 Anderson et al. ..... 219/412
3,699,307 10/1972 Malkin ..... 219/412
4,227,062 10/1980 Payne et al. ..... 219/10.55 B
4,332,992 6/1982 Larsen et al. ..... 219/10.55 R
4,345,134 8/1982 Tanaka et al. ..... 219/10.55 B
4,687,908 8/1987 Thorne ..... 219/400

*Primary Examiner*—Philip H. Leung
*Attorney, Agent, or Firm*—Lee, Mann, Smith, McWilliams & Sweeney

[57] ABSTRACT

A microwave oven has electrical resistance heating elements (38*a*, 38*b*), a fan (36) for passing air over the heating elements and through the oven cavity (10) and a magnetron for delivering microwave power to the oven cavity. The oven is intended for use in commercial establishments such as cafés, petrol filling stations or railway stations and is capable of occupying a stand-by mode pending insertion of a foot item into the oven cavity (10). During the stand-by mode the electrical resistance heating elements are energized at a lower power level (continuously or in pulses) in order to provide a reservoir of heat which speeds the cooking process. The oven is capable of occupying the stand-by mode continuously.

8 Claims, 4 Drawing Sheets

MICROWAVE OVEN WITH STAND-BY MODE

FIELD OF INVENTION

This invention relates to microwave ovens.

BACKGROUND OF THE INVENTION

The invention was devised to provide a microwave oven suitable for commercial use in establishments such as cafes, petrol filling stations or railway stations.

SUMMARY OF THE INVENTION

According to the invention a microwave oven has a food-receiving cavity, a magnetron for delivering microwave power to the cavity, electrical resistance heating means, a fan for passing air over the heating means to provide a flow of forced hot air through the cavity, and thermostatic control means for controlling the temperature of the air heated by the heating means, wherein the oven has a stand-by mode which the oven assumes after switching on and in which the oven is ready and waiting for a food item to be loaded into the cavity to commence a looking process, the oven being capable of occupying the stand-by mode indefinitely until a food item is loaded into the cavity, in the stand-by mode the fan being de-energised for all or the majority of the time and the heating means being energised continuously or in pulses, subject to thermostatic control by the thermostatic control means, in order to provide a reservoir of heat at the commencement of the cooking process.

In the stand-by mode the fan may be energised intermittently in order to keep warm the cavity walls and any oven accessories such as turntables or racks, for example being energised for a predetermined number of seconds every few minutes, e.g. 15 seconds every 3 minutes.

Preferably, however, the fan remains completely deenergised during the stand-by mode.

The thermostatic control means may comprise a thermistor located adjacent the fan and the thermostatic control may be such as to limit the air temperature to an upper threshold temperature of the order of 200° C. during the stand-by mode. Hence, during the stand-by mode the air temperature is maintained at or near this threshold level so that when a food item is placed in the oven and cooking is commenced there is a reservoir of heat which reduces the overall cooking time. However, the cavity remains cool during the stand-by mode, in comparison with cavity temperatures reached during cooking.

The electrical resistance heating means may include two electrical resistance heating elements which are energised alternately in succession during the stand-by mode. The two elements are preferably located adjacent one another. The object of having two elements is to avoid the visible red glow which would be produced by a single element during the stand-by mode.

The cooking time may be manually entered by the user, or a microprocesser of the oven may be pre-programmed with certain food items or dishes, such as fish and chips, hamburger and chips, sausage roll, chicken and chips or soup. In this latter case the user selects the appropriate food item, (e.g. from a supply of frozen food items) inserts the food item into the microwave oven which will be in the stand-by mode and will press a key pad appropriate to the selected food item. The oven will defrost and then complete the cooking process and indicate to the user when cooking is complete.

The oven will then revert to the stand-by mode ready for the next item to be cooked.

The cooking process may have a power change-over point at which thermal power is increased and microwave power is decreased, in order to bring the temperature (as detected by the thermistor) to the same level at the end of cooking as at the begining of cooking, enabling the oven to revert to the stand-by mode at the end of cooking with appropriate temperature levels. Prior to the power change-over point, one only of the pair of electrical resistance heating élements is preferably energised, both electrical resistance heating elements being energised after the power change-over point, in order to provide the desired increase in thermal power. For microwave ovens designed to operate in the UK and continental Europe and having a power rating of 3000 watts, the change-over point preferably occurs after about three quarters of the cooking time has elapsed. For ovens designed to operate in the USA or Japan, where domestic power ratings are more modest, the power change-over point may occur earlier in the cooking process. In all cases, the total cooking time is manually entered by the user or predicted by the oven in dependence upon the food item selected, so that the microprocessor of the oven can calculate when the change-over point should occur, and can then implement the power change-over at the required power change-over point.

A microwave oven forming a preferred embodiment of the invention will now be described by way of example with reference to the accompanying drawings, in which.

Figure 4:
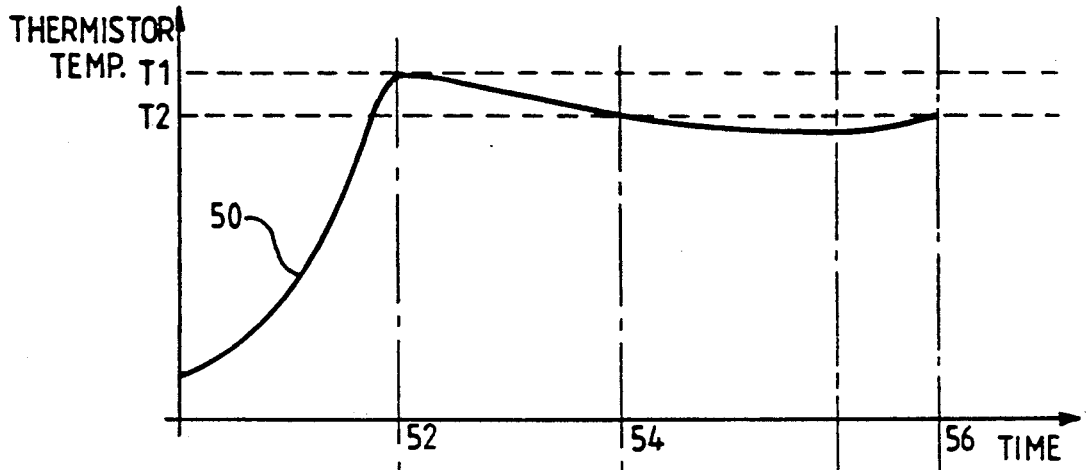
Figure 5A:
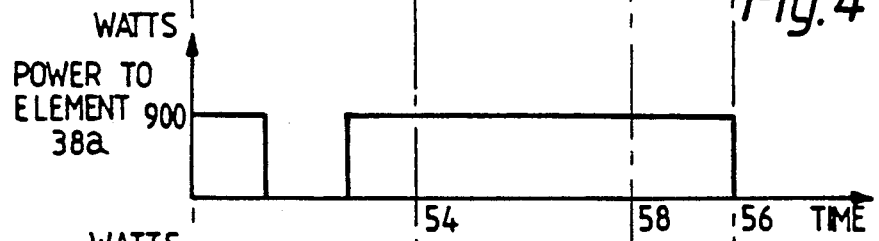

FIGS. 4, 5*a*, r*b*, 6 and 7 are graphs showing the operation of the oven.

The oven is intended to be powered from an ordinary socket outlet and is similar in construction and in circuit U.K. patent specifications 2127658A and 2137860A. In particular, the oven has a food-receiving cavity 10 which is closable by a hinged front door 12 and in the base of which is located a rotatable turntable 14. A magnetron (not shown) delivers microwave power to the cavity through an inlet 16, and cooling air from a magnetron blower fan is capable of entering the cavity through a perforated inlet 18. The rear panel 20 of the cavity has a perforated outlet aperture 22 and a perforated inlet aperture 24, these two apertures respectively serving for the exit and entry of forced air to the cavity. The cavity has a further vent 25, a perforated area 26 which is illuminated, and the front of the casing of the oven has a control panel 30.

Figure 1:
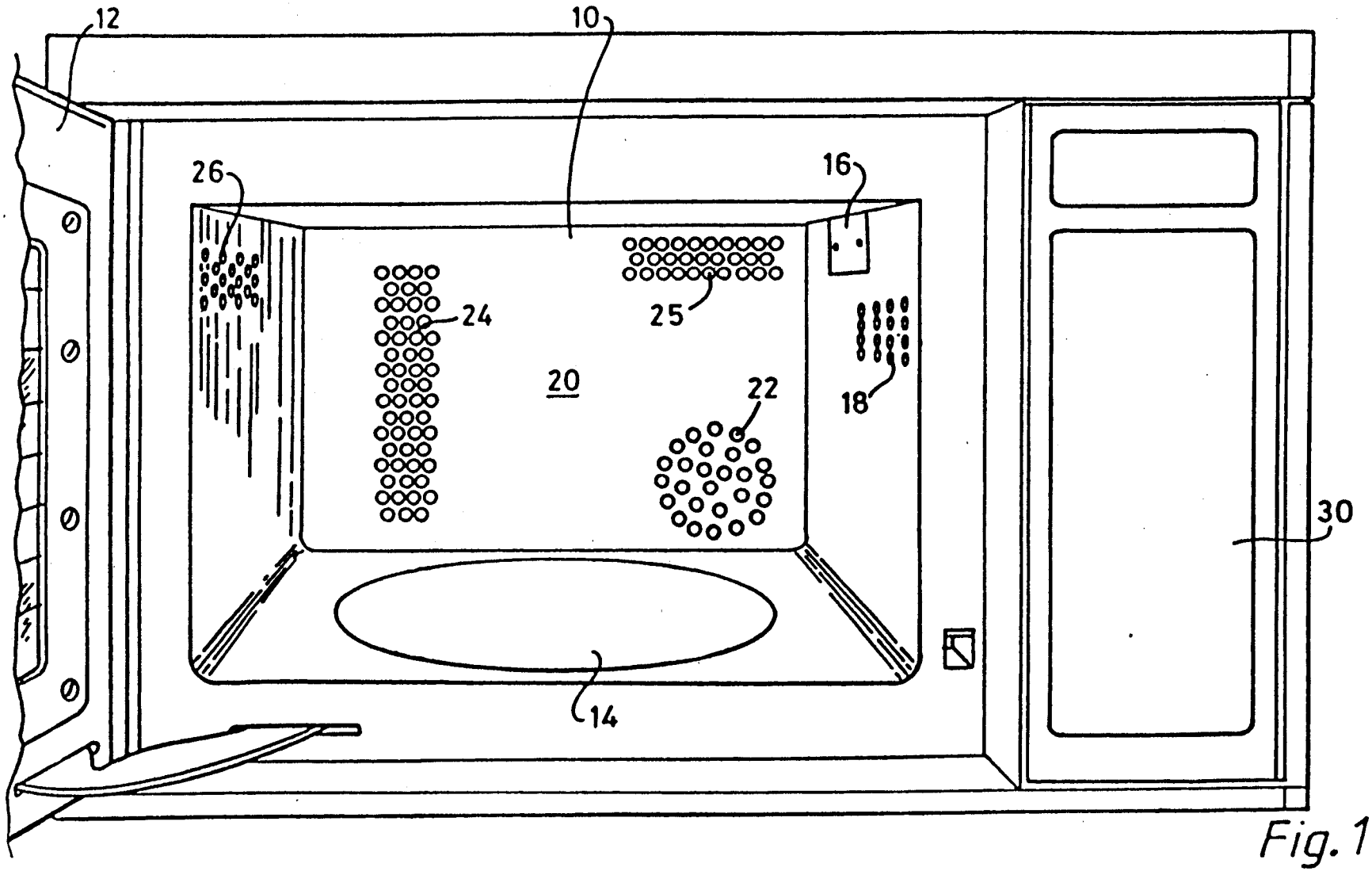
FIG. 1 is a front perspective view of the oven with an oven door open.
Figure 2:
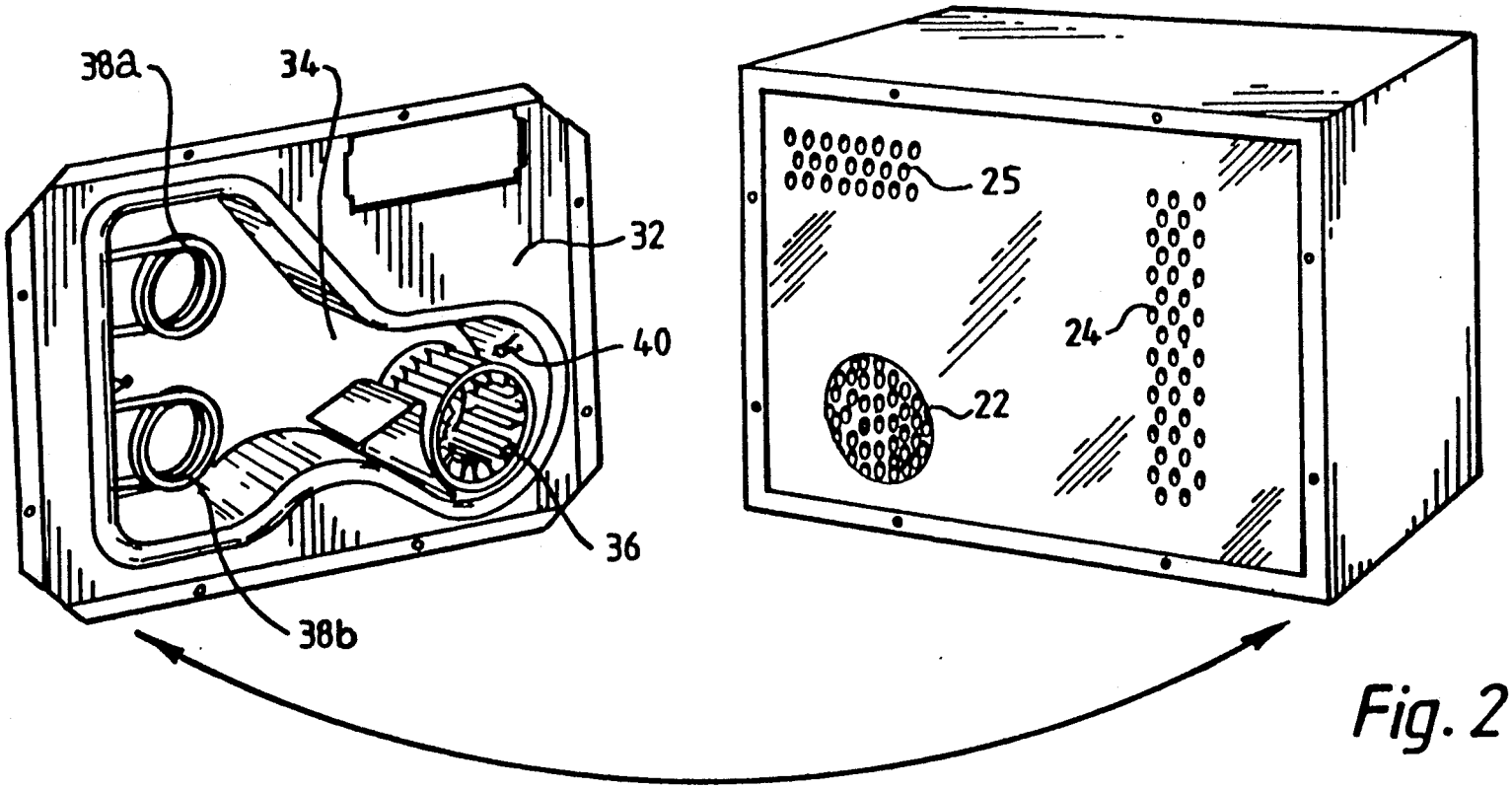
FIG. 2 shows the rear of the oven with a rear panel removed to show a hot air compartment of the oven.
Figure 3:
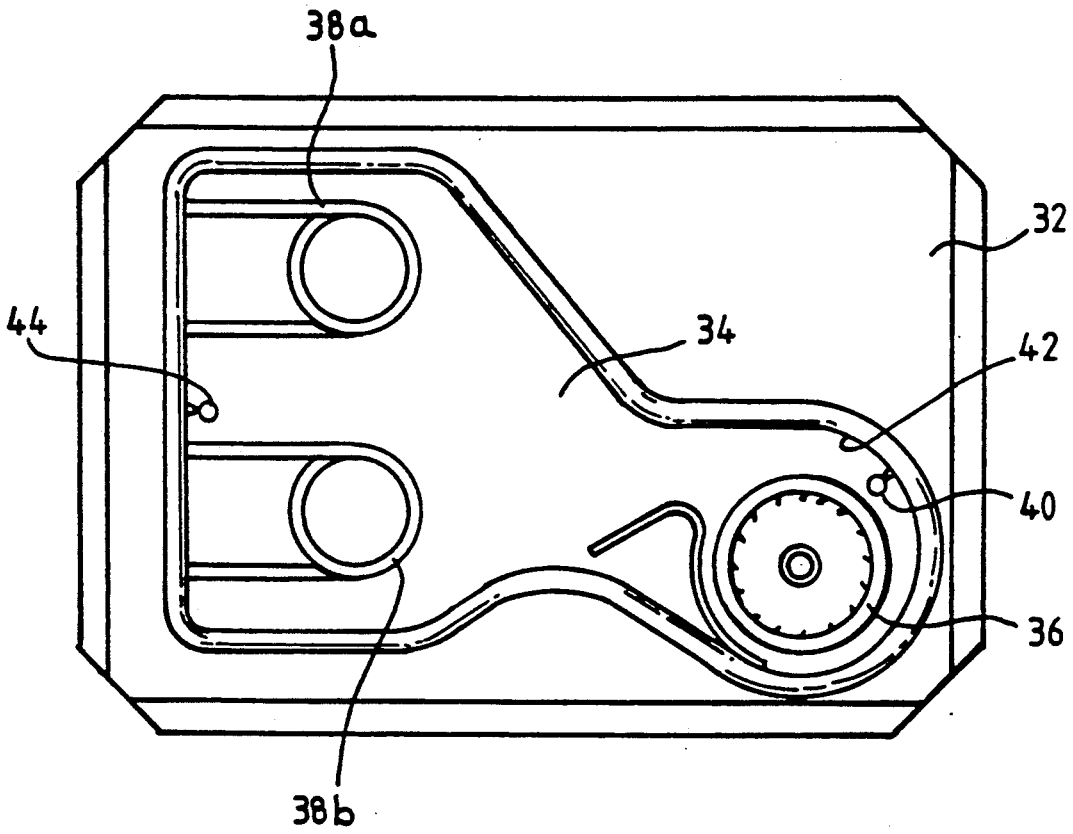
FIG. 3 is an elevation showing the casing and associated elements defining the hot air compartment.

Referring to FIGS. 2 and 3, the rear of the oven has a casing 32 shaped to provide a hot air compartment 34 through which air passes behind the panel 20. Within the compartment 34 are located a fan 36, disposed behind the outlet aperture 22, and a pair of electrical resistance heating elements 38i a, 38i b (each of 900 watts) disposed behind the inlet aperture 24. The fan 36 is rotatable about a horizontal axis and has around its periphery a plurality of impeller blades which draw air from the cavity 10, through the outlet aperture 22, and thence force the air over the electrical resistance heating elements 38*a* and 38*b* where it is heated, before redirecting the air back into the cavity 10 through the inlet aperture 24.

A temperature sensor in the form of a thermistor bead 40 is located in the compartment 34 at a position spaced midway between the outer periphery of the blades of the fan 36 and the adjacent wall 42 defining the peripheral margin of the hot air compartment in this region. It will be seen from FIG. 3 that the thermistor bead 40 is located at an angle of about 45° from a vertical line passing through the rotational axis of the fan 36. In this oven, the conventional thermistor bead 44 is not needed and is dispensed with. Signals from the thermistor bead 40 provide an accurate indication of cooking progress and the variations of temperature with time, as detected by the thermistor bead 40, are used by a microprocessor of the oven in order to control the magnitudes and durations of the microwave power and hot air power, in a manner now to be described.

FIG. 4 is a graph showing air temperature as detected by the thermistor 40 plotted against time on the horizontal axis. When the oven is initially switched on from cold the elements 38*a*, 38*b* are both energised, the convection fan 36 is energised, the magnetron cooling fan is also energised but the magnetron remains de-energised. The air temperature as detected by the thermistor 40 rises, as indicated by the curve 50, until an upper threshold T1 of the order of 200° C. is detected. At this point (designated 52 on the time axis) the oven assumes its stand-by mode.

Figure 5B:
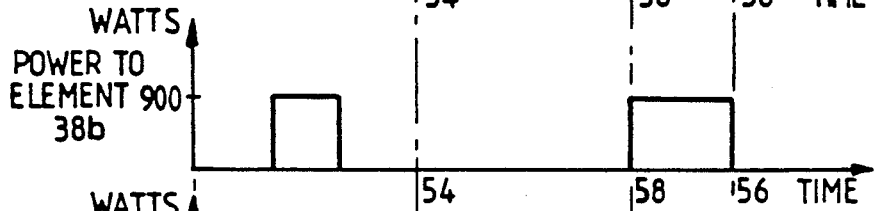
Figure 6:
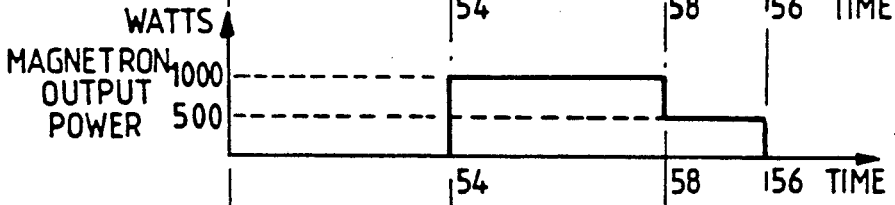

In the stand-by mode the convection fan 36 and the magnetron are de-energised. FIGS. 5*a* and 5*b* respectively show the pattern of energisation of the two electrical resistance heating elements 38*a* and 38*b*. These two elements are energised alternately in sequence, each pulse of energisation lasting 30 seconds and there being a 10 second interval (during which neither element is energised) between the end of one pulsed period of energisation of one of the elements 38*a*, 38*b* and the beginning of the next pulsed period of energisation of the other of the elements. This alternate pulsed energisation of the elements 38*a* and 38*b* continues so long as the stand-by mode lasts, in order to maintain a reservoir of heat in the compartment 34.

Point 54 in FIGS. 4 to 7 represents the commencement of a cooking process, it being understood that between points 52 and 54 the oven is in the stand-by mode.

The user selects the food item from a selection of food items, and enters the selected food item into the oven microprocessor by touching a key on the display 30. The oven door is opened and the food item is inserted in the oven. When the door is closed at time 54, cooking commences. During cooking the convection fan 36 and the magnetron fan are both energised and microwave power and simultaneous hot air power are produced, at a high microwave input level of 1000 watts (FIG. 6) combined with hot air of 900 watts from element 38*a* (FIG. 5*a*). During cooking the hot air temperature as detected by the thermistor bead 40 is limited to about 240° C., by thermostatic control of the element 38*a*. The oven is automatically programmed to complete cooking after a preset time dependent on the food item being cooked. The end of cooking is indicated by time 56, after which the oven reverts to the stand-by mode ready to receive the next item to be cooked.

For food items having a predicted cooking time of between 2 and 6 minutes, it has been found advantageous to switch in more thermal power and reduce microwave power at a power change over point indicated at 58. At the power change-over point 58, the second element 38*b* is energised and the power delivered into the cavity by the magnetron is reduced from 1000 watts to 500 watts. This change-over point is preferably timed at three quarters of the total cooking time i.e., the period from time 58 to 56 is one quarter of the total cooking time from time 54 to time 56.

Figure 7:
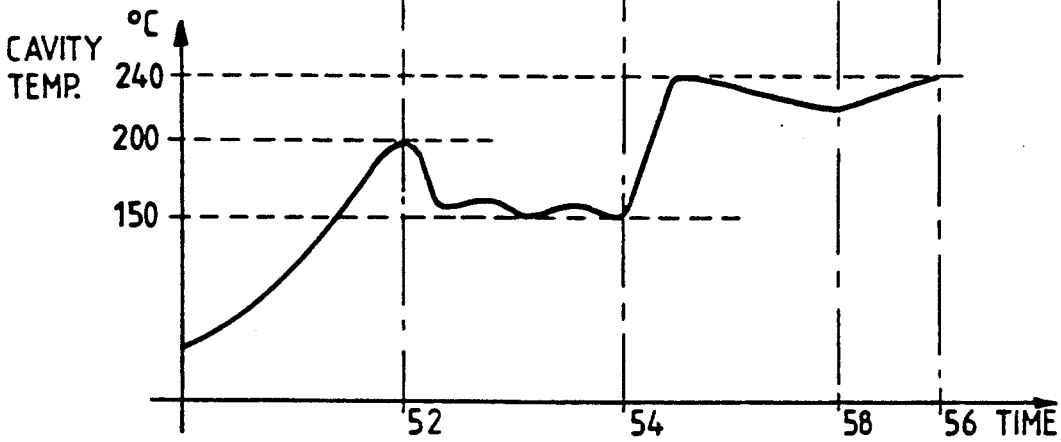

It has been found that food items having a predicted cooking time of less than 2 minutes or more than 6 minutes are best cooked without any power change-over point, ie the element 38*a* is energised throughout the cooking time at 900 watts and the magnetron is energised throughout the cooking time to deliver 1000 watts into the cavity. FIG. 7 is a plot of cavity temperature against time from switch on to the end of cooking at time 56. It must be noted that during the stand-by mode (between 52 and 54) the cavity temperature is fairly modest (about 150° C.) but that it rises rapidly on commencement of cooking at time 54. It will also be noted from FIG. 4 that the temperature detected by the thermister 40 is substantially the same at the end of cooking at 56 as it is at the beginning of cooking at time 54, thermostatic control maintaining the air temperature between the thresholds T1 and T2.

The described power levels apply to a microwave oven suitable for UK and continental European power levels. For the U.S.A., where power limits of a socket restrict the input power of a microwave oven to about 1650 watts, the elements 38*a* and 38*b* have respective power ratings of 400 and 1000 watts, and the magnetron has a high power level of 650 watts and a low power level of 350 watts into the cavity. In this case the change over point 58 is about half way through the cooking time.

For Japan, where the total input from a socket is limited to 1350 watts, the elements 38*a* and 38*b* have respective ratings of 400 and 800 watts, and the magnetron has a high power level of 500 watts into the cavity and a low power level of 300 watts into the cavity. In this case the change-over point occurs after 30% to 40% (preferably about 36%) of the total cooking time has elapsed.

The oven can remain indefinitely in the stand-by mode, in which no moving parts are energised and in which the oven cavity does not get dangerously hot. The reservoir of heat resulting from the energisation of the elements 38*a*, 38*b* during the stand-by mode enables high microwave power levels to be used during cooking.

I claim:

1. A microwave oven having a food-receiving cavity, a magnetron for delivering microwave power to the cavity, electrical resistance heating means disposed within a compartment adjacent to the cavity, a fan for passing air over the heating means to provide a flow of forced hot air through the cavity, and thermostatic control means for controlling the temperature of the air heated by the heating means, wherein the oven has a stand-by mode which the oven assumes after switching on and in which the oven is ready and waiting for a food item to be loaded into the cavity, the oven being capable of occupying the stand-by mode indefinitely until a food item is loaded into the cavity to commence a cooking process, means for maintaining the fan and magnetron de-energised during the stand-by mode and means for energising the heating means at least in pulses during the stand-by mode, subject to thermostatic control by the thermostatic control means, in order to provide a reservoir of heat in the compartment at the commencement of the cooking process and in order to maintain the cavity cool, relative to cooking temperatures, during the stand-by mode.

2. A microwave oven according to claim 1, wherein the thermostatic control means comprise a thermistor located in the compartment adjacent the fan and the thermostatic control means limits the air temperature to an upper threshold temperature during the stand-by mode.

3. A microwave oven according to claim 1, wherein the electrical resistance heating means include two electrical resistance heating elements which are energised alternately in succession during the stand-by mode.

4. A microwave oven according to claim 3 including a microprocessor for controlling the delivery of microwave power and the energisation of the electrical resistance heating means, wherein for food items having a predicted cooking time within a predetermined time range, the microprocessor has programmed therein a power change-over point at which thermal power is increased and microwave power is decreased, in order to bring the air temperature to the same level at the end of the cooking process as at the beginning of the cooking process, enabling the oven to revert to the stand-by mode at the end of the cooking process.

5. A microwave oven according to claim 4, wherein the microprocessor controls the oven such that prior to the power change-over point, one only of the pair of electrical resistance heating elements is energised, both electrical resistance heating elements being energised after the power change-over point, in order to provide the desired increase in thermal power.

6. A microwave oven according to claim 4, wherein the oven has a power rating for supply from a European socket outlet, and the microprocessor controls the oven such that the change-over point occurs when substantially three quarters of the total cooking time has elapsed.

7. A microwave oven according to caim 4, wherein the oven has a power rating for supply from a United States of America socket outlet, and the microprocessor controls the oven such that the change-over point occurs when substantially half of the total cooking time has elapsed.

8. A microwave oven according to claim 4, wherein the oven has a power rating for supply from a Japanese socket outlet, and the microprocessor controls the oven such that the change-over point occurs when substantially one third of the total cooking time has elapsed.

* * * * *